US009486670B2

(12) United States Patent
Maximillian et al.

(10) Patent No.: US 9,486,670 B2
(45) Date of Patent: Nov. 8, 2016

(54) EXERCISE APPARATUS

(71) Applicant: Maxquip Pty Ltd, Myaree (AU)

(72) Inventors: Laurie Maximillian, Willagee (AU); Edward Joseph Khoury, Bateman (AU)

(73) Assignee: MAXQUIP PTY LTD, Wangara (AU)

( * ) Notice: Subject to any disclaimer, the term of this patent is extended or adjusted under 35 U.S.C. 154(b) by 0 days.

(21) Appl. No.: 14/407,065

(22) PCT Filed: Jun. 5, 2013

(86) PCT No.: PCT/AU2013/000595

§ 371 (c)(1),
(2) Date: Dec. 10, 2014

(87) PCT Pub. No.: WO2013/185168

PCT Pub. Date: Dec. 19, 2013

(65) Prior Publication Data

US 2015/0133280 A1 May 14, 2015

(30) Foreign Application Priority Data

Jun. 12, 2012 (AU) ..... 2012902440

(51) Int. Cl.

| | |
|---|---|
| ***A63B 21/02*** | (2006.01) |
| ***A63B 26/00*** | (2006.01) |
| ***A63B 22/18*** | (2006.01) |
| ***A63B 23/04*** | (2006.01) |
| *A63B 71/00* | (2006.01) |

(52) U.S. Cl.

CPC ..... *A63B 26/003* (2013.01); *A63B 22/18* (2013.01); *A63B 23/0458* (2013.01); *A63B 71/0036* (2013.01); *A63B 2208/0204* (2013.01); *A63B 2210/50* (2013.01); *A63B 2225/62* (2013.01)

(58) Field of Classification Search

USPC ..... 482/1–148

See application file for complete search history.

(56) References Cited

U.S. PATENT DOCUMENTS

| | | | | |
|---|---|---|---|---|
| 5,730,690 | A * | 3/1998 | Guidry | A63B 21/0004 482/146 |
| 6,767,313 | B2 * | 7/2004 | Sayce | A63B 69/18 482/146 |
| 7,300,392 | B1 * | 11/2007 | Curran | A63B 21/0004 482/146 |
| 7,686,751 | B2 * | 3/2010 | Carlson | A63B 69/0066 482/146 |

(Continued)

*Primary Examiner* — Stephen Crow

(74) *Attorney, Agent, or Firm* — Tope-McKay & Associates

(57) ABSTRACT

An exercise apparatus (10) comprising a first rigid member (12) having a first surface (18) that rests on the ground in use and a second rigid member (14) having a first surface (18) on which a person can be supported. At least one resilient member (16) is provided to extend between a second surface (19) of the first rigid member (12) and a second surface (19) of the second rigid member (14). Recesses (20, 21) are provided in the second surfaces (19) of each of the first and second rigid members (12, 14) such that each of the resilient members (16) includes a first end portion (22) secured into the recess (20, 21) in the second surface (19) of the first rigid member (12) and a second end portion (23) secured into the recess (20, 21) in the second surface (19) of the second rigid member (14).

19 Claims, 10 Drawing Sheets

(56) References Cited

U.S. PATENT DOCUMENTS 7,775,952 B1 * 8/2010 Curran ..... A63B 22/18 482/146
7,993,253 B2 * 8/2011 Fernandez ..... A63B 22/18 482/146
8,075,426 B1 * 12/2011 Griffin ..... A63B 69/0002 473/271
8,734,308 B1 * 5/2014 Joslin ..... A63B 22/16 482/142
2004/0014571 A1 * 1/2004 Haynes ..... A63B 21/0004 482/142
2004/0023766 A1 * 2/2004 Slone ..... A63B 22/18 482/146
2006/0082089 A1 * 4/2006 Rejtano ..... A63B 22/18 280/87.042
2007/0149374 A1 * 6/2007 Carlson ..... A63B 22/16 482/146
2008/0020856 A1 * 1/2008 Rosa ..... A63B 26/003 473/269
2008/0234116 A1 * 9/2008 Elzerman ..... A63B 21/015 482/123
2015/0251056 A1 * 9/2015 Crist ..... A63B 22/18 482/146
2015/0321051 A1 * 11/2015 Olson ..... A63B 21/4037 482/139

* cited by examiner

SECTION A-A

DETAIL A 10
15
20
31
40
41
30
13
DETAIL A 15
18
20
31
30
13
21
A

EXERCISE APPARATUS

FIELD OF THE INVENTION

The present invention relates to exercise apparatus.

BACKGROUND OF THE INVENTION

A wide range of exercises are available to exercise various parts of the body in a standing position. While such exercises have traditionally been performed while standing on a solid surface, it has been realised that there are benefits to performing various exercises on a surface that has some degree of instability. The act of balancing during the exercise has been shown to provide useful additional exercise to a range of muscles.

Devices are available to provide such an unstable surface on which a person can exercise. On such example comprises the device sold under the trade name "Bosu Ball". This device comprises an inflatable dome mounted to a base surface. The user can perform a range of exercises and stretches either standing or resting part of their body on the inflatable dome.

The present invention relates to an exercise apparatus of the type for providing an unstable surface on which a person can perform various exercises having an improved construction to assist with both usability and transport and storage.

SUMMARY OF THE INVENTION

According to one aspect of the present invention there is provided an exercise apparatus comprising:

a first rigid member having a first surface that rests on the ground in use;

a second rigid member having a first surface on which a person can be supported;

at least one resilient member provided to extend between a second surface of the first rigid member and a second surface of the second rigid member; and recesses provided in the second surfaces of each of the first and second rigid members corresponding to each resilient member;

wherein each of the resilient members includes a first end portion secured into one of the recesses in the second surface of the first rigid member and a second end portion secured into one of the recesses in the second surface of the second rigid member.

Preferably the first rigid member comprises a first planar member and the second rigid member comprises a second planar member. Preferably each resilient member comprises an inflatable member.

In a preferred embodiment, there is provided a first inflatable member and a second inflatable member and the second surface of each of the first and second planar members includes a first recess and a second recess.

Preferably each of the first recesses are provided between a midpoint of the second surface and a first end thereof and each of the second recesses are provided between the midpoint of the second surface and a second opposite end thereof.

Preferably the second surface of the first planar member can be engaged with the second surface of the second planar member when the inflatable members are in a deflated state, with the deflated inflatable members being contained between the recesses in the first and second planar members.

In one embodiment, the exercise apparatus further comprises:

first cylindrical portions provided on first ends of each of the inflatable members;

second cylindrical portions provided on second ends of each of the inflatable members;

compressible flanges around the periphery of the distal ends of the first and second cylindrical portions; and securing rings having an internal diameter less than the external diameter of the flanges;

wherein each flange is compressible such that it can be received within the securing ring and each securing ring is securable to the adjacent planar member within the recess.

In one embodiment, the securing rings are affixed to the adjacent planar member by securing screws.

Preferably the second surfaces of each of the first and second planar members are provided with one or more connectors such that the connectors on the first planar member can engage with the connectors on the second planar member when the inflatable members are deflated.

In one embodiment the connectors comprise first connectors provided on the second surface of the first planar member and complementary shaped second connectors provided on the second surface of the second planar member.

In one embodiment, each of the first and second connectors comprises a protruding portion and a recessed portion such that the protruding portion of each of the first connectors engages into the recessed portion of the corresponding second connector and the recessed portion of each of the first connectors receives the protruding portion of the corresponding second connector.

The protruding portions and recessed portions define in one embodiment a generally S-shaped surface wherein the shape and orientation of the S-shaped surfaces are such that the first and second connectors engage together in a snap fit manner.

In one embodiment, each of the planar members are of generally rectangular shape.

In one embodiment, each of the first and second planar members is provided with a cover extending over at least a portion of the first surface thereof constructed of a material for providing grip when a user stands on the cover. The covers may include surface features for providing further grip.

BRIEF DESCRIPTION OF THE DRAWINGS

The invention will now be described, by way of example, with reference to the following drawings, in which.

DETAILED DESCRIPTION OF PREFERRED EMBODIMENTS

Figure 1:
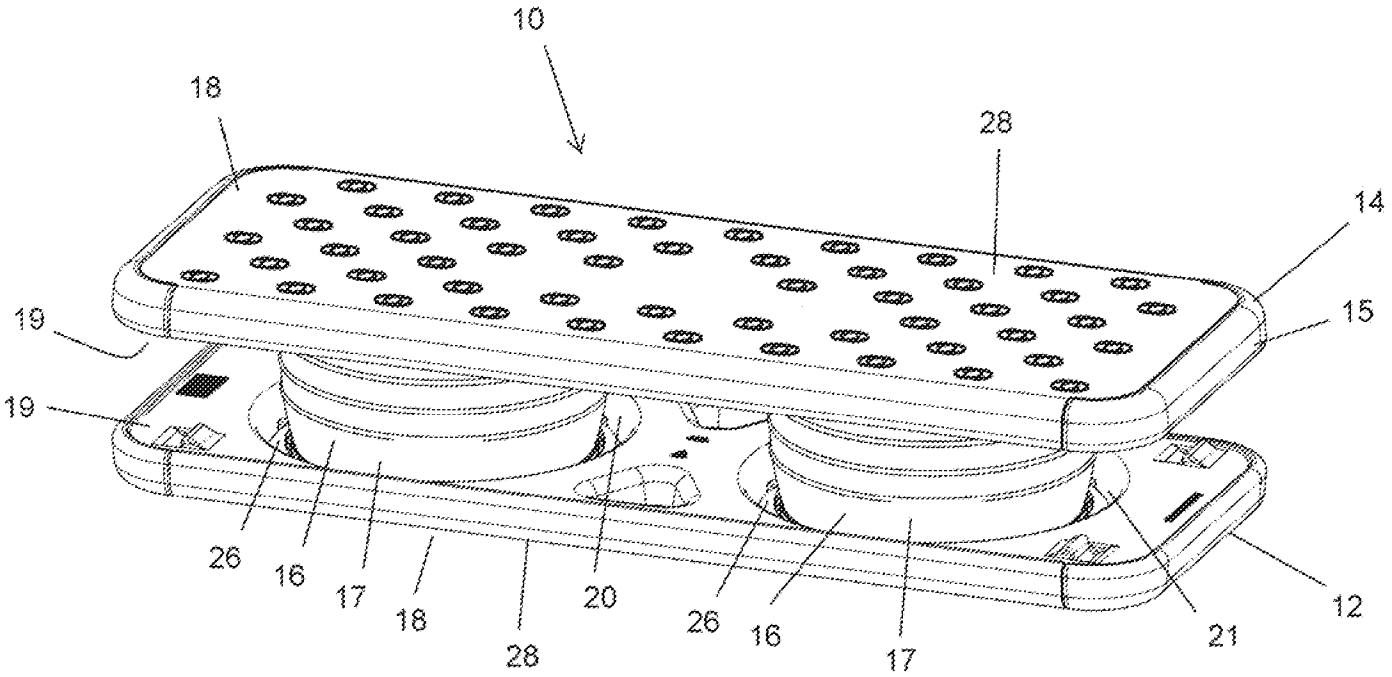
FIG. 1 is an upper perspective view of an exercise apparatus in accordance with the present invention.
Figure 2D:
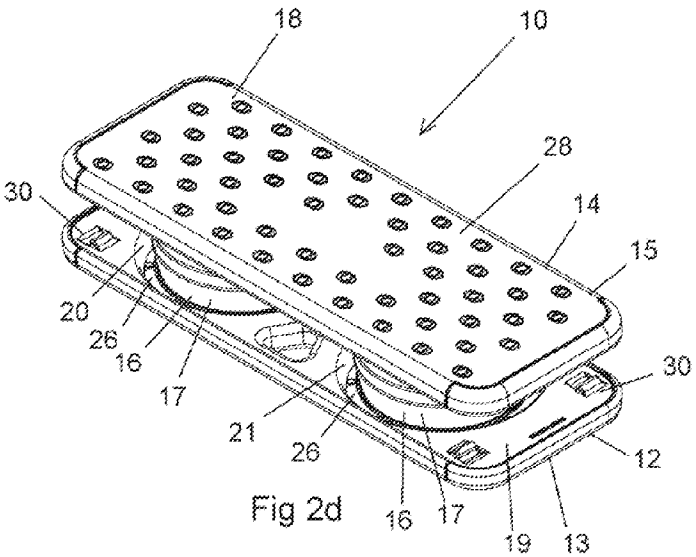
FIG. 2*d* is an upper perspective view of the exercise apparatus of FIG. 1.
Figure 2E:
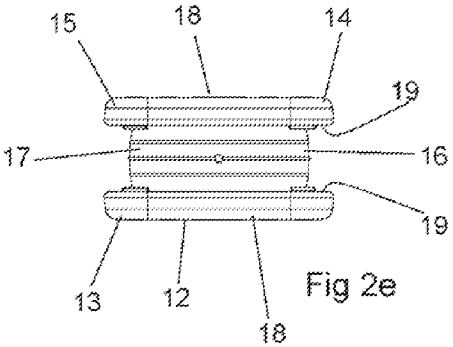
FIG. 2*e* is an end view of the exercise apparatus of FIG. 1.
Figure 2C:
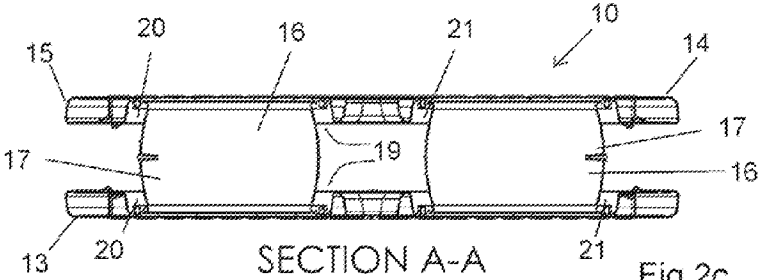
FIG. 2*c* is a cross sectional view of the exercise apparatus of FIG. 2*a* through the line A-A.
Figure 2A:
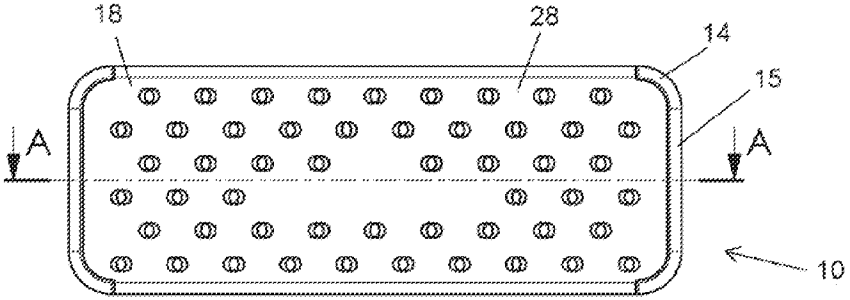
FIG. 2*a* is a top view of the exercise apparatus of FIG. 1.
Figure 2B:
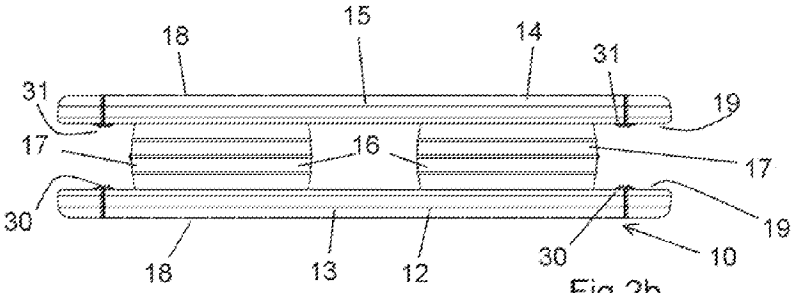
FIG. 2*b* is a front view of the exercise apparatus of FIG. 1.
Figure 3:
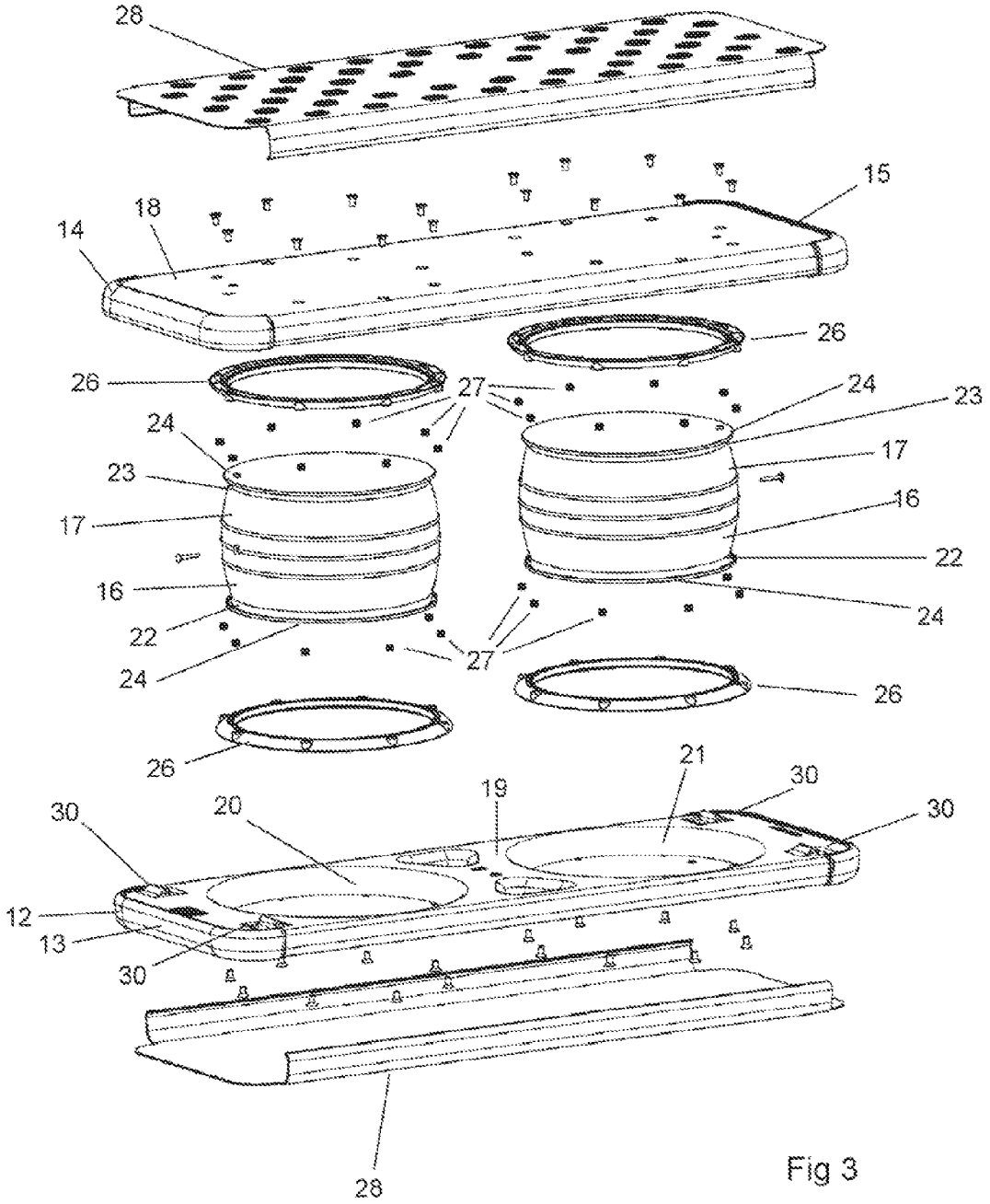
FIG. 3 is an exploded view of the exercise apparatus of FIG. 1.
Figure 4:
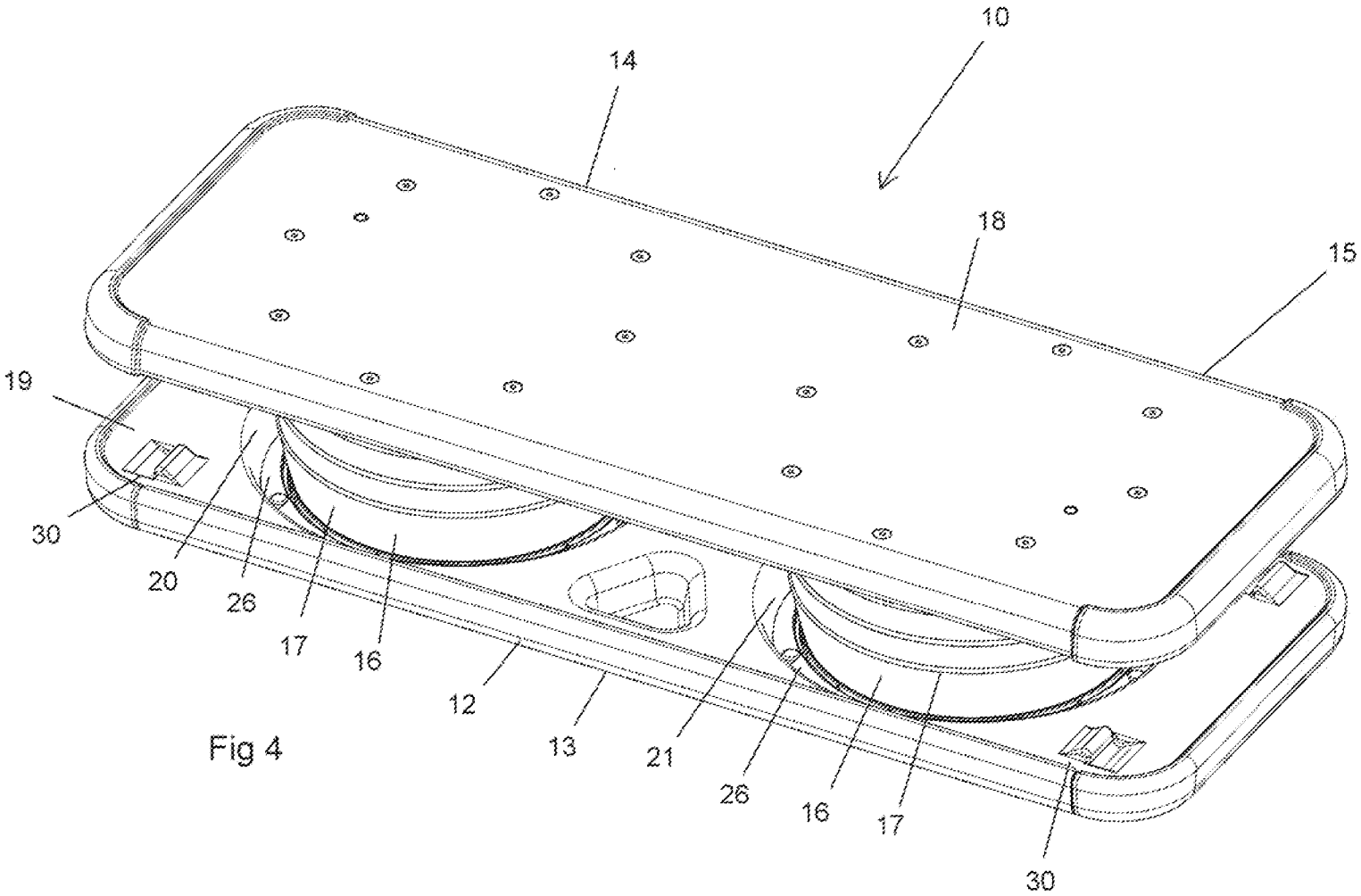
FIG. 4 is an upper perspective view of the exercise apparatus of FIG. 1 with the top cover removed.

Referring to Figures, there is shown an exercise apparatus 10 in accordance with the present invention. The exercise apparatus 10 comprises a first rigid member 12, a second rigid member 14 and one or more resilient members 16 located between the first and second rigid members 12 and 14.

In the embodiment shown, the first rigid member 12 comprises a first planar member of generally rectangular shape. The second rigid member 14 comprises a second planar member of generally rectangular shape. The first planar member includes a first surface 18 to rest on the ground in use and a second surface 19 oriented upwardly. The second planar member 15 is located above the first planar member 15 and includes a first surface 18 arranged facing upwardly and a second surface 19 oriented downwardly towards the second surface 19 of the first planar member.

The resilient members 16 are provided between the first and second planar members and 15 such that when the first planar member rests on the ground, the second planar member 15 is supported above the first planar member. That is, the resilient members 16 rest on the second surface 19 of the first planar member and the second surface 19 of the second planar member 15 rests on top of the resilient members 16.

In the embodiment shown, there are provided two resilient members 16. Each resilient member 16 is provided in the form an inflatable member 17. In the embodiment shown, each inflatable member 17 comprises an inflatable cylinder. It will be appreciated however that the inflatable members 17 may be formed in other shapes, such as spherical.

The second surfaces 19 of the first and second planar members and 15 each include a first recess 20 and second recesses 21 therein. The first recess 20 is provided between a midpoint of the second surface 19 and a first end thereof. The second recess 21 is provided between the midpoint of the second surface 19 and a second opposite end thereof. The first of the inflatable members 17 is received in the first recess 20 of the first planar member and the first recess 20 of the second planar member 15. The second of the inflatable members 17 is received in the second recess 21 of the first planar member and the second recess 21 of the second planar member 15.

Each of the inflatable members 17 is connected to the second surfaces 19 of the planar members and 15 within the recesses 20 and 21. Each inflatable member 17 includes a first cylindrical portion 22 at a first end thereof and a second cylindrical portion 23 on a second opposite end thereof. Each of the first and second cylindrical portions 22 and 23 includes a flange 24 around the periphery of the distal end thereof.

Associated with each of the flanges 24 is a securing ring 26. The internal diameter of each securing ring 26 is less than the external diameter of the flanges 24. Each flange 24 is compressible such that it can be compressed to be received within the securing ring 26. The securing ring 26 is then affixed to the adjacent planar member or 15 by suitable means such as securing screws 27. The securing rings 26 are secured such that the first and second end portions 22 and 23 of each of the inflatable members 17 are secured within the respective recesses 20 and 21. The recesses 20 and 21 are generally cylindrical in shape having a circular planar inner surface to which the securing rings 26 are secured.

Each of the first and second planar members and 15 is provided with a cover 28. The covers 28 are provided to extend over at least a portion of the first surfaces 18 of the first and second planar members and 15. The covers 28 are constructed of a material for providing grip when a user stands on the cover 28. The covers 28 may also include surface features for providing such grip.

The second surfaces 19 of each of the first and second planar members and 15 are provided with one or more connectors such that the connectors on the first planar member can engage with the connectors on the second planar member 15 when the inflatable members 17 are deflated. As shown in FIG. 9, when the inflatable members 17 are deflated, the second surfaces 19 of the first and second planar members and 15 can engage and the deflated inflatable members 17 are received between the recesses 20 and 21.

The connectors comprise first connectors 30 provided on the second surfaces 19 of the first planar member and second connectors 31 provided on the second surface 19 of the second planar member 15. In the embodiment shown, there is provided a pair of first connectors 30 adjacent the first end of the first planar member and a pair of first connectors 30 provided adjacent the second end of the first planar member. A pair of second connectors 31 is provided adjacent the first end of the second planar member and a pair of second connectors 31 is provided adjacent the second end of the second planar member 15. Each of the first connectors 30 is provided to engage with a corresponding one of the second connectors 31.

Figures 9A, 9B:
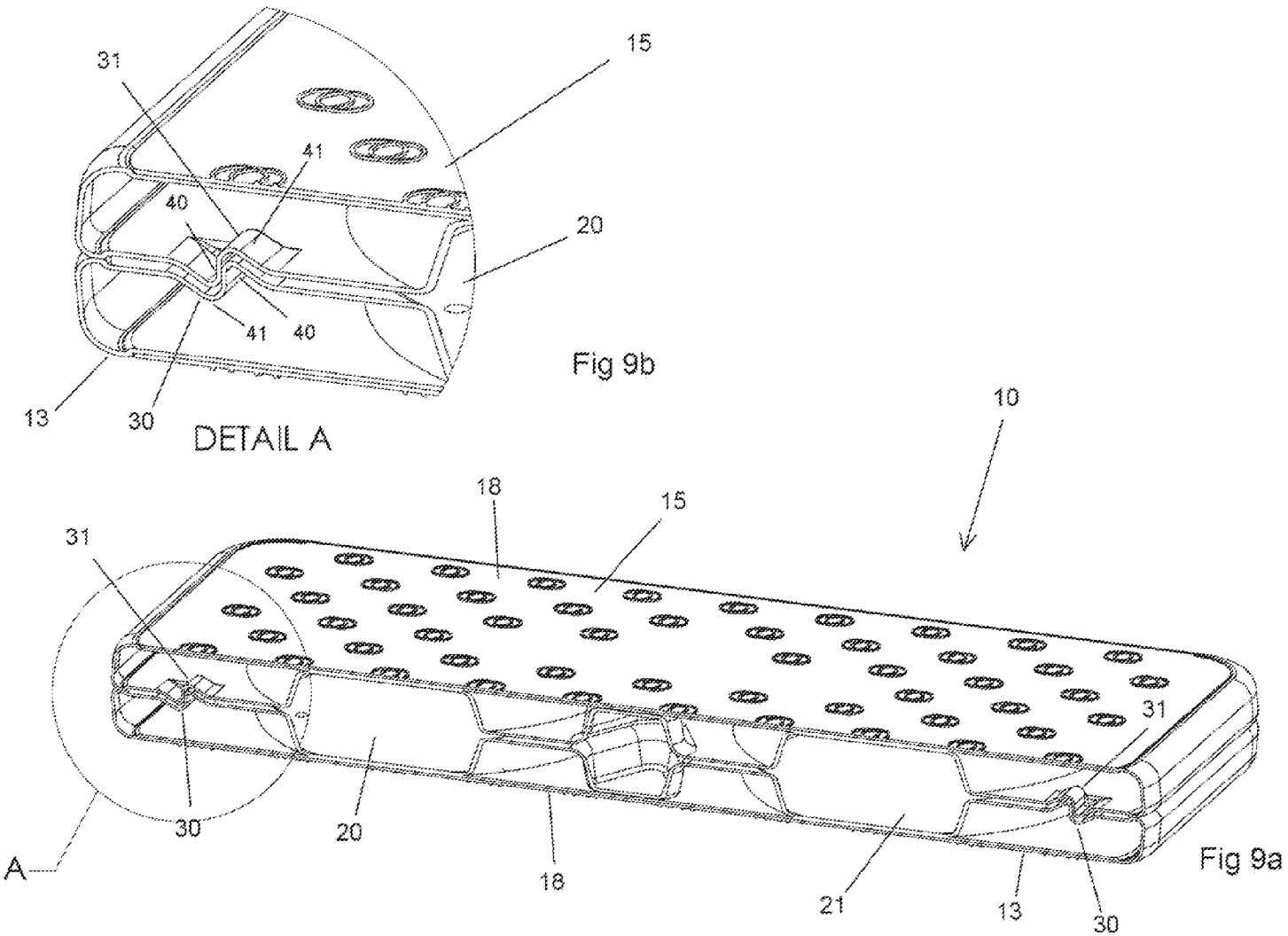
FIG. 9*a* is an upper perspective view of the exercise apparatus in the configuration of FIG. 8 with front portions cut away.
FIG. 9*b* is a close up view of Detail. A of FIG. 9*a*.
Figure 10:
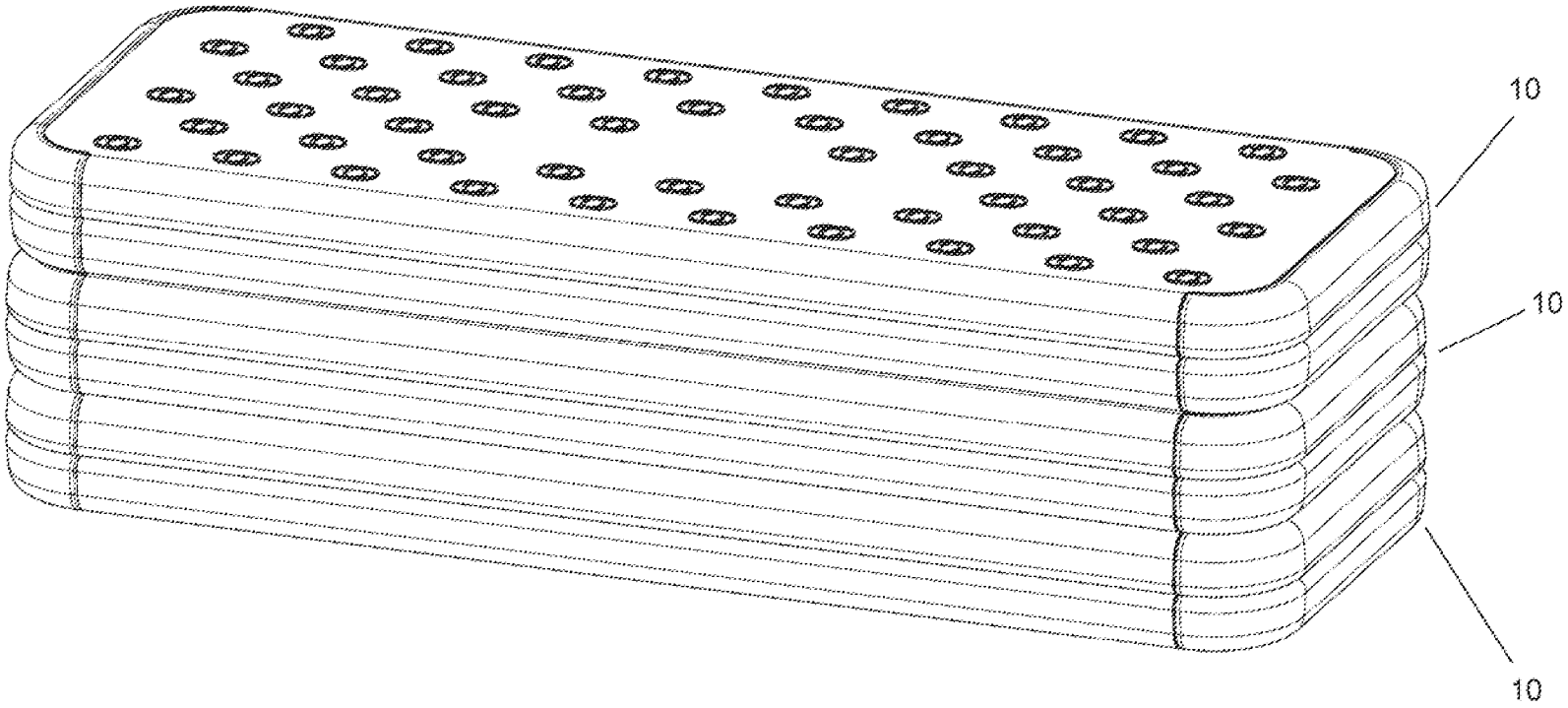
FIG. 10 is an upper perspective view of three exercise apparatus in a stacked configuration.

The shape of each of the first connectors 30 is complementary to the shape of the corresponding second connector 31 such that the first connector 30 can engage with the corresponding second connector 31. In the embodiment shown, each of the first connectors 30 comprises a protruding portion 40 and a recessed portion 41 (as best seen in FIG. 9*b*). Each of the second connectors 31 also comprises a protruding portion 40 and a recessed portion 41. The protruding portions 40 and recessed portions 41 define a generally S-shaped surface.

The protruding portion 40 of each of the first connectors 30 engages into the recessed portion 41 of the corresponding second connector 31 and the recessed portion 41 of each of the first connectors 30 receives the protruding portion 40 of the corresponding second connector 31 (as can be seen in FIG. 9). The shape and orientation of the S-shaped surfaces are such that the first and second connectors engage together in a snap fit manner with application of sufficient force to retain the first and second planar members and 15 together for transport and/or storage. The first and second connectors 30 and 31 can be disengaged by pulling the first and second planar members and 15 apart with sufficient force.

Figure 5:
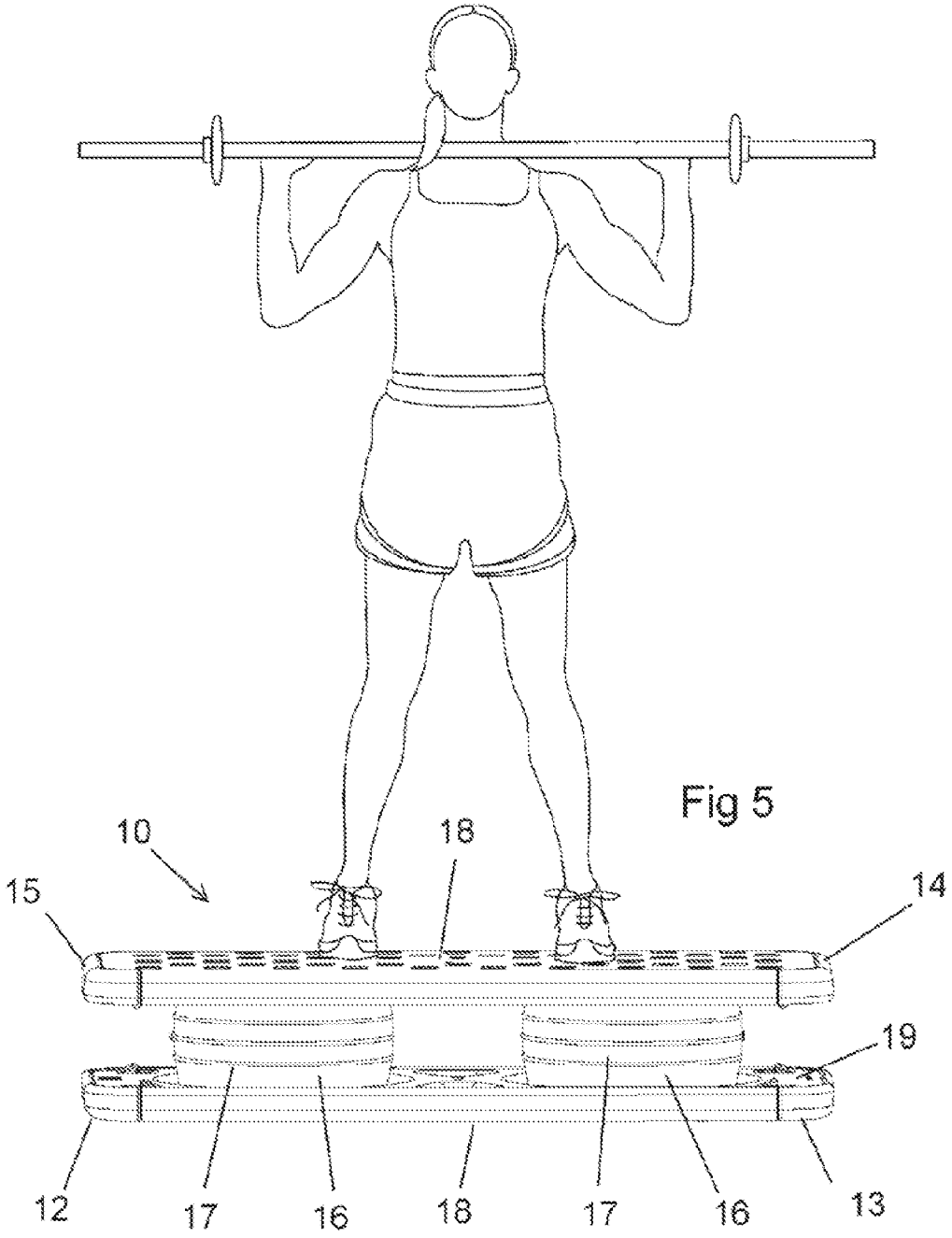
FIG. 5 is a front view of the exercise apparatus of FIG. 1 in use.
Figure 6:
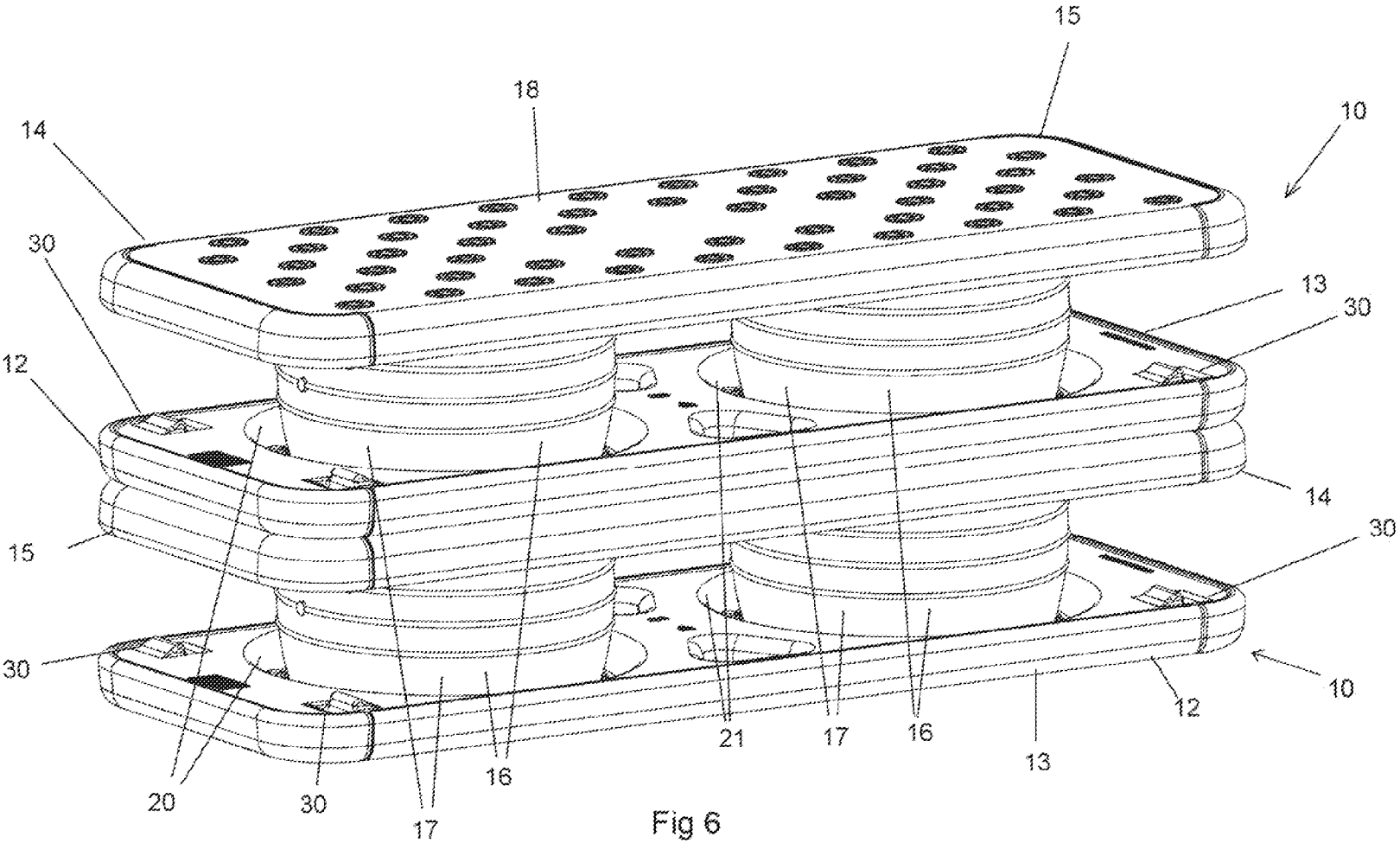
FIG. 6 is an upper perspective view of two of the exercise apparatus stacked together.
Figure 7A:
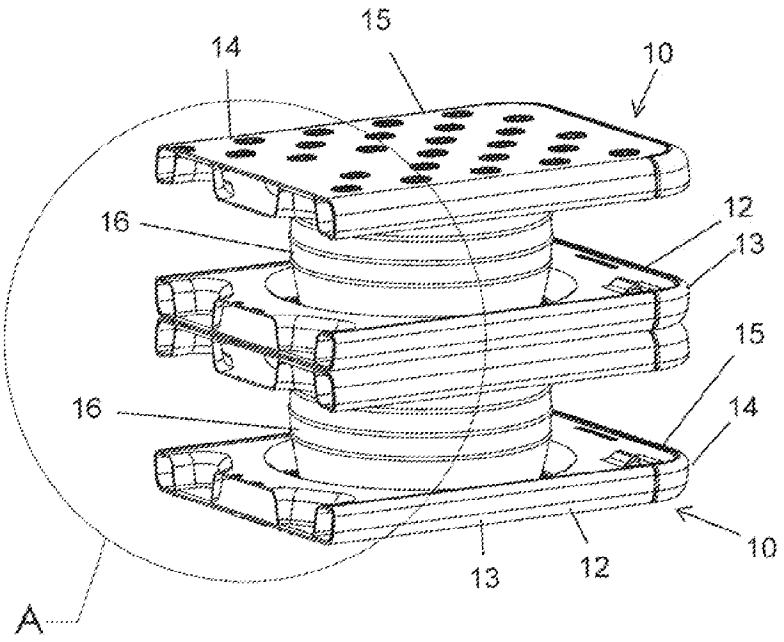
FIG. 7*a* is an upper perspective view of the stacked exercise apparatus with end portions cut away.
Figure 7B:
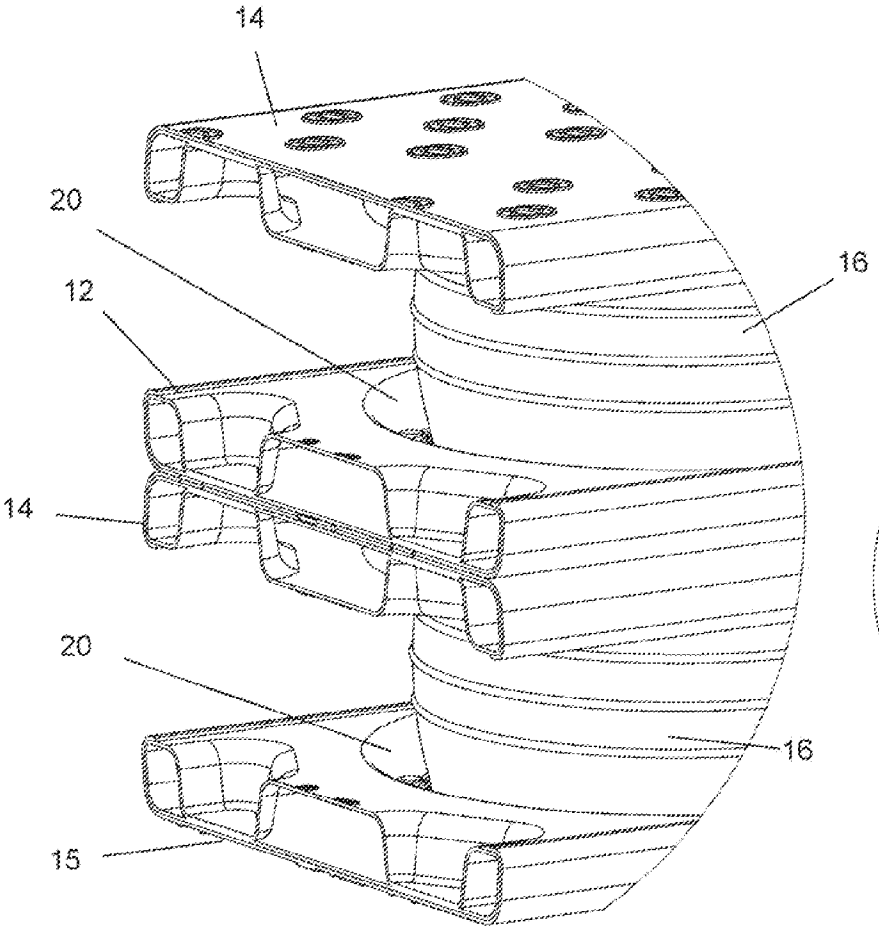
FIG. 7*b* is a close up view of Detail A of FIG. 7*a;*
Figure 8:
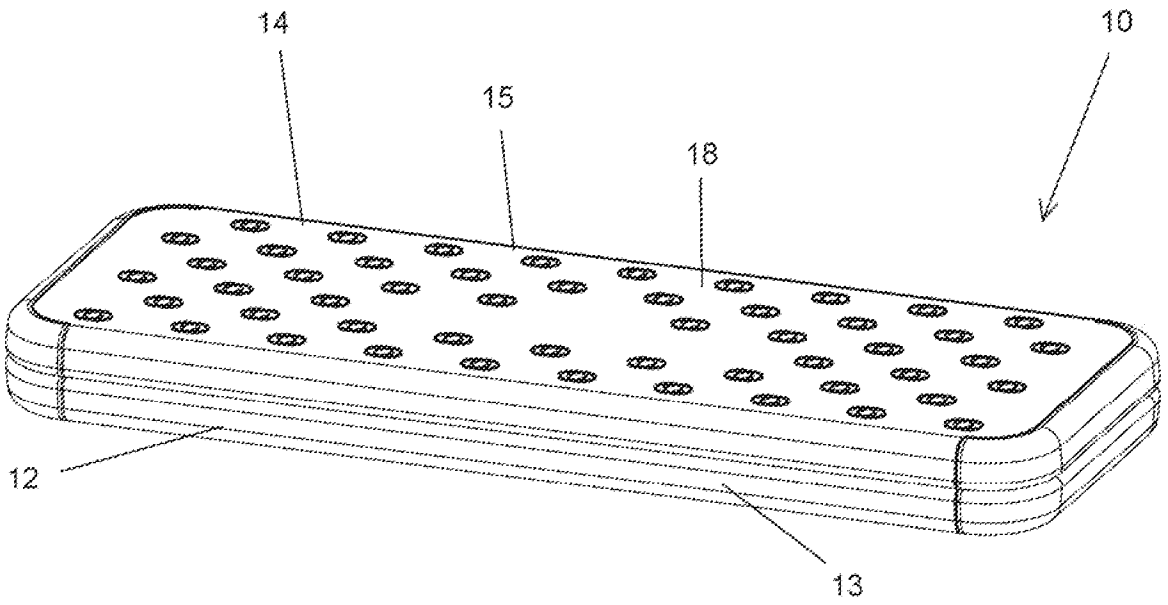
FIG. 8 is an upper perspective view of the exercise apparatus of FIG. 1 with the resilient members deflated.

In use, the exercise apparatus 10 is placed on the ground with the inflatable members 17 inflated to the desired pressure. As shown in FIG. 5, a person can stand on the first surface 18 of the second planar member 15 and perform various exercises. The resilient nature of the inflatable members 17 results in movement of the second planar member 15 relative to the first planar member. The person performing the exercises must therefore compensate for this movement while exercising, thereby providing an enhanced workout.

It will be readily apparent to persons skilled in the relevant arts that various modifications and improvements may be made to the foregoing embodiments, in addition to those already described, without departing from the basic inventive concepts of the present invention.

What is claimed is:

1. An exercise apparatus comprising:

a first rigid member having a first surface that rests on the ground in use;

a second rigid member having a first surface on which a person can be supported;

at least one resilient member provided to extend between a second surface of the first rigid member and a second surface of the second rigid member, each of the resilient members comprising a first end portion secured to the second surface of the first rigid member, and a second end portion secured to the second surface of the second rigid member;

a first cylindrical portion provided on the first end of each resilient member;

a second cylindrical portion provided on the second end of each resilient member;

flanges around the periphery of the distal ends of the first and second cylindrical portions; and securing rings having an internal diameter less than the external diameter of flanges;

wherein each flange is receivable within the securing ring and each securing ring is securable to the adjacent planar member.

2. The exercise apparatus as set forth in claim 1, wherein the first rigid member comprises a first planar member, the second rigid member comprises a second planar member, and the second surfaces of each of the first and second planar members include recesses such that when the second surfaces of the first and second planar members are engaged, the resilient members are contained within the recesses.

3. The exercise apparatus as set forth in claim 2, wherein each resilient member comprises an inflatable member.

4. The exercise apparatus as set forth in claim 3, wherein there is provided a first inflatable member and a second inflatable member and the second surface of each of the first and second planar members includes a first recess and a second recess.

5. The exercise apparatus as set forth in claim 4, wherein each of the first recesses are provided between a midpoint of the second surface and a first end thereof and each of the second recesses are provided between the midpoint of the second surface and a second opposite end thereof.

6. The exercise apparatus as set forth in claim 5, wherein the second surface of the first planar member can be engaged with the second surface of the second planar member when the inflatable members are in a deflated state, with the deflated inflatable members being contained between the recesses in the first and second planar members.

7. The exercise apparatus as set forth in claim 1, wherein each flange is compressible such that it can be received within the securing ring.

8. The exercise apparatus as set forth in claim 7, wherein the securing rings are affixed to the adjacent planar member by securing screws.

9. The exercise apparatus as set forth in claim 8, wherein the second surfaces of each of the first and second planar members are provided with one or more connectors such that the connectors on the first planar member can engage with the connectors on the second planar member when the inflatable members are deflated.

10. The exercise apparatus as set forth in claim 9, wherein the connectors comprise first connectors provided on the second surface of the first planar member and complementary shaped second connectors provided on the second surface of the second planar member.

11. The exercise apparatus as set forth in claim 10, wherein each of the first and second connectors comprises a protruding portion and a recessed portion, such that the protruding portion of each of the first connectors engages into the recessed portion of the corresponding second connector, and the recessed portion of each of the first connectors receives the protruding portion of the corresponding second connector.

12. The exercise apparatus as set forth in claim 11, wherein the protruding portions and recessed portions define a generally S-shaped surface.

13. The exercise apparatus as set forth in claim 12, wherein the shape and orientation of the S-shaped surfaces are such that the first and second connectors engage together in a snap fit manner.

14. The exercise apparatus as set forth in claim 13, wherein each of the planar members are of generally rectangular shape.

15. The exercise apparatus as set forth in claim 14, wherein each of the first and second planar members is provided with a cover extending over at least a portion of the first surface thereof constructed of a material for providing grip when a user stands on the cover.

16. The exercise apparatus as set forth in claim 15, wherein the covers comprise surface features for providing further grip.

17. The exercise apparatus as set forth in claim 4, wherein the second surfaces of each of the first and second planar members are provided with one or more connectors such that the connectors on the first planar member can engage with the connectors on the second planar member when the inflatable members are deflated.

18. The exercise apparatus as set forth in claim 2, wherein each of the planar members are of generally rectangular shape.

19. The exercise apparatus as set forth in claim 2, wherein each of the first and second planar members is provided with a cover extending over at least a portion of the first surface thereof constructed of a material for providing grip when a user stands on the cover.

* * * * *